US005335958A

United States Patent [19]

Christenson et al.

[11] Patent Number: 5,335,958

[45] Date of Patent: Aug. 9, 1994

[54] AUTOMATIC POSITIVE TAILGATE LATCHING MECHANISM

[75] Inventors: Ronald E. Christenson, Kasson; Brandon McNeilus, Dodge Center, both of Minn.

[73] Assignee: McNeilus Truck and Manufacturing, Inc., Dodge Center, Minn.

[21] Appl. No.: 18,962

[22] Filed: Feb. 18, 1993

[51] Int. Cl.[5] ..... B65F 3/00

[52] U.S. Cl. ..... 296/56; 292/300; 49/254

[58] Field of Search ..... 296/56; 292/300; 49/254, 255, 257, 258; 414/406

[56] References Cited

U.S. PATENT DOCUMENTS

| | | | |
|---|---|---|---|
| 1,105,464 | 7/1914 | Stickler | 296/56 |
| 3,272,552 | 9/1966 | Park . | |
| 3,440,763 | 4/1969 | O'Brien . | |
| 3,757,969 | 9/1973 | Smith | 296/56 X |
| 3,815,950 | 6/1974 | McKenzie et al. | 296/56 |
| 3,873,149 | 3/1975 | Churchman | 296/56 |
| 3,990,739 | 11/1976 | Head | 296/56 |
| 4,307,541 | 12/1981 | Farmer et al. . | |
| 5,141,280 | 8/1992 | Gerrard | 296/56 X |

FOREIGN PATENT DOCUMENTS

| | | | |
|---|---|---|---|
| 1238989 | 6/1986 | U.S.S.R. | 296/56 |

*Primary Examiner*—Dean J. Kramer
*Attorney, Agent, or Firm*—Haugen and Nikolai

[57] ABSTRACT

A tailgate latching mechanism for latching a vertical tailgate to the rear structure of the truck body of a rearward or side compacting, rear discharge refuse truck in which the tailgate is pivotally mounted from pivot pins in top hinges fixed to the top rear of the truck body. The mechanism includes upper and lower pairs of spaced, vertically interlocking side latches for absorbing the horizontal forces associated with compacting and compacted refuse when latched, a pair of self-aligning vertical stops to prevent vertical displacement of the tailgate when closed, and a system for vertically adjusting the pivot pins allowing vertical displacement of the tailgate associated with latching and unlatching the vertically interlocking latches. Bottom drop in retainers are also provided.

4 Claims, 7 Drawing Sheets

12
56
46
44
54
34
51
48
50
28
58
52
53
60
62
82
40
64
42

46
40
54
74
34
56
44
70
62
76
60
72
64
81
82
78
80
40

40
34
46
74
54
44
56
70
64
62
58
76
60
40
80
72
64
78
82

AUTOMATIC POSITIVE TAILGATE LATCHING MECHANISM

BACKGROUND OF THE INVENTION

1. Field of the Invention

The present invention is directed generally to truck bodies having top hinged pivoting rear gates including those designed specifically for refuse hauling. More particularly, the invention concerns an improved positive tailgate latching mechanism for rearward compacting, rear discharge refuse hauling trucks which relieves hinge stress, prevents ride up and automates latching and unlatching of the tailgate. Applicable to both front-loading or side-loading rear discharge vehicles, the invention allows automated remote operation of the tailgate.

2. Description of the Related Art

Trucks performing specialized tasks as for loading, hauling and discharging various types of loads such as refuse are common. These vehicles include a basic truck chassis fitted with a distinctly configured separate body that is typically designed, built and installed on the chassis by a second manufacturer. The truck body is, then, specifically designed to accommodate desired specialty tasks. A refuse truck, for example, includes, in addition to a storage container, systems for receiving, compacting and discharging refuse materials complete with all the associated operating mechanisms.

One successful design of refuse hauling truck bodies is known as a "front loader" and includes a refuse hauling reservoir accessible for loading through a hopper cover in the top front portion of the vehicle body. A rather large, substantially vertically disposed tailgate forms the closure for the rear of an elongated refuse holding reservoir aft of or including the receiving hopper. This system includes an hydraulic compacting mechanism which is used to repeatedly compact the refuse rearward with great force after each loading. In this manner, refuse eventually fills the available or usable reservoir volume extending from the front end back toward the rear of the body until no more material can be compacted.

The tailgate closing the rear of the container is designed to be raised vertically and swung outward to open. It is hingedly connected at the top rear of the truck body and is equipped with a pair of side mounted cylinders to displace it vertically and pivot it about the hinges. The bottom of the tailgate, when lowered or in the closed position, is typically secured by dog-ear type drop-in latches in the lower rear structural supports in the back of the refuse truck body. The tailgate may be opened by raising it slightly using the cylinders to clear the drop-in latches and thereafter pivoting upward to completely expose the rear of the reservoir. The collection and compaction systems are operated with the tailgate down and latched to the truck body. Ejection of the accumulated contents is accomplished when the tailgate is unlatched and swung upward and out of the way and the entire rear of the refuse holding reservoir is open so that the collected material may just be pushed rearward and discharged from the body of the truck beneath the raised tailgate.

The compacting mechanism is operated by an hydraulic cylinder which mounts behind the cab and reciprocally moves a large blade member against the refuse in the manner of a snowplow. The packing blade also serves as the ejector blade. As the refuse is compacted aft on an horizontal plane against the tailgate, it serves not only as a closure means but also as an end wall which must be capable of withstanding the full force of the compacting operation and compacted refuse. The top hinge mechanisms and the bottom latches are the only points of support for the tailgate. The compacting and holding of compacted refuse, then, necessarily produces a great deal of corresponding strain in the hinge mechanism and in the bottom latches. As a result of the forces against it, prior tailgates also tend to ride up and may even unlatch. The top pivot members of the hinge mechanism must be extremely rugged in construction and, even so, the extreme conditions also produce undue wear on moving parts.

Accordingly, it is a primary object of the present invention to provide an integral automatic latching mechanism which overcomes the above-enumerated problems.

Another object of the invention it to provide an integral automatic latching mechanism that reduces the stress on the top pivot members produced by refuse compacted within the vehicle refuse container volume and precludes the tendency of the tailgate to ride up during compaction by the provision of latches to secure the sides of the tailgate in addition to the top and bottom when the tailgate is in the lowered position.

A further object of the invention is to provide pairs of double hook drop-in latches to secure the sides of the tailgate such that the horizontal force against the tailgate is carried by the latches.

Another object of the present invention is to provide positive vertical stops to prevent the closed tailgate from riding up.

A still further object of the invention is to enable the automatic positive tailgate latching mechanism to be operated entirely by a pair of vertically disposed hydraulic cylinders, one on each side of the rear of the vehicle.

These and other objects will become apparent in view of the description below taken together with the several drawings and the claims appended hereto.

SUMMARY OF THE INVENTION

In accordance with the present invention, problems associated with prior tailgate mechanisms in rearward compacting, rear discharge, front- or side-loading refuse vehicles are solved by the provision of an improved automatic tailgate mechanism which includes both upper and lower positive side latches. The upper side latches relieve the horizontal strain on the top tailgate pivoting mechanism and the lower side latches carry the bulk of the outward force in the central part of the tailgate. Bottom drop-in latches contain the force associated with the lower part of the tailgate. The latching mechanism of the invention utilizes two pairs of vertically operating hook latches in conjunction with a pair of positive vertical stops to secure the sides of the tailgate and prevent upward displacement of the tailgate. These are in addition to a plurality of drop-in, dog-ear type devices used to secure the bottom. A pair of generally vertically disposed hydraulic cylinders, one on each side of the rear of the vehicle, operate to secure the stops and hooks in place when fully contracted and operate to raise the tailgate sufficiently for the dog-ears and hooks to clear and thereafter pivotally open the tailgate for ejection. The system, in addition to providing integral automatic latching with respect to both the lower and side areas of the tailgate reduces the stress on the top pivot members by shifting it to the upper side latches. In this manner, the tailgate pivoting system need only be designed to carry the weight of the tailgate itself without reference to the stress of the compaction operation and the force exerted by the compacted refuse.

BRIEF DESCRIPTION OF THE DRAWINGS

In the drawings, wherein like numerals are utilized to designate like parts throughout the same.

DETAILED DESCRIPTION

Whereas but one side is depicted in the views of FIGS. 1–6, it is to be understood that generally symmetrically disposed like mechanisms are situated on the opposite side and operate in complete harmony or unison with those depicted. The system will now be described generally with respect to one side of the truck body, it being intended where necessary that the description apply equally to the identical undisclosed side.

Figure 1:
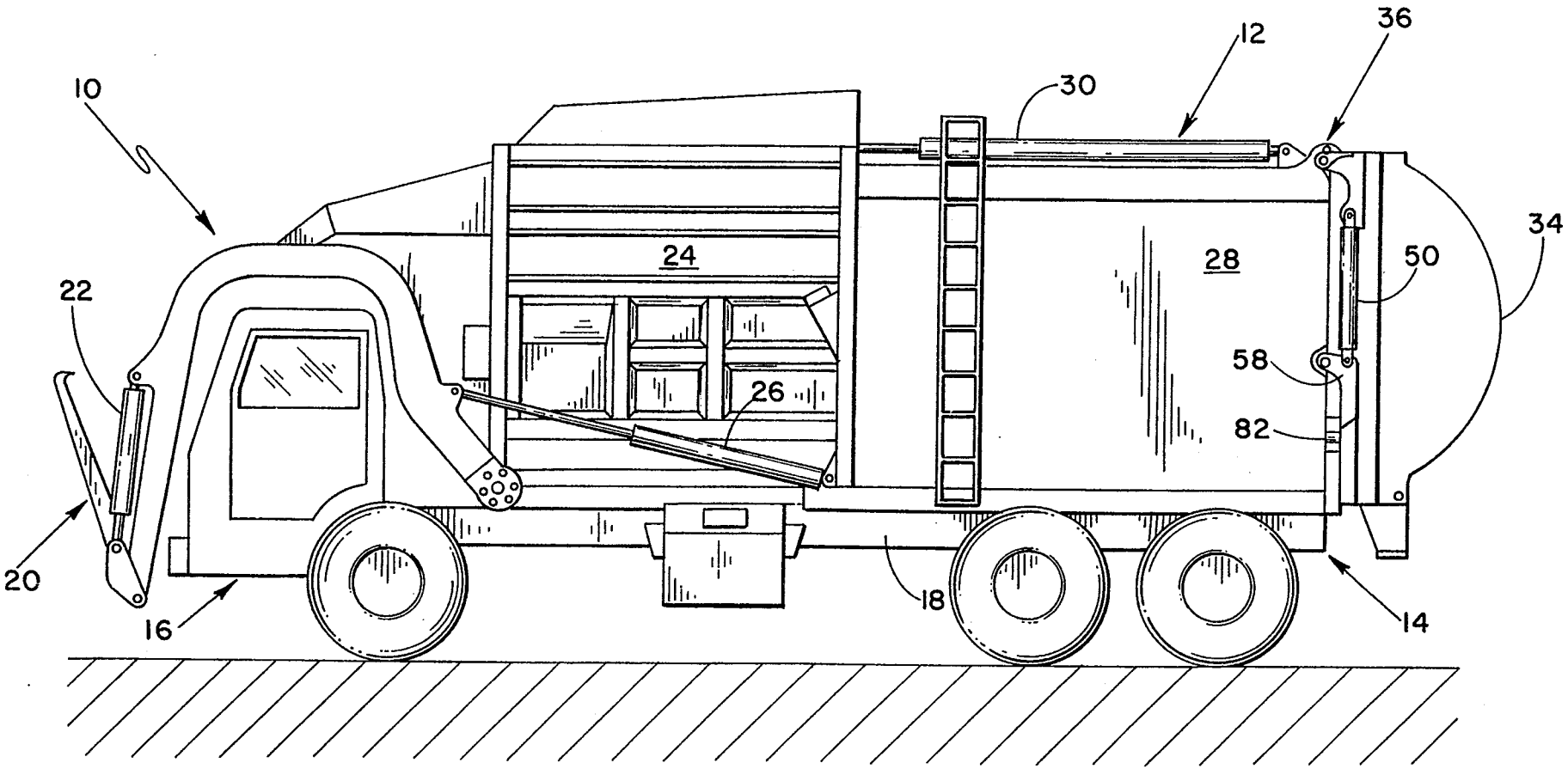
FIG. 1 is a side elevational view of a front-loading refuse vehicle equipped with the tailgate latching mechanism of the invention.

FIG. 1 depicts a side elevational view of a typical front loading refuse vehicle 10 including a front-loading refuse collecting and ejecting body 12 mounted on a truck chassis 14 which includes a cab section 16 and a plurality of longitudinal body support members as at 18. A lift and dump mechanism including a dumpster box engaging means 20 in operating lift cylinders as at 22 and dump cylinders as at 26 are used to lift refuse boxes over the cab and tilt and empty them into the refuse hopper 24 of the truck body 12. A packer blade (not shown) operated by a cylinder compacts the refuse received in a hopper 24 rearward into the large hollow storage chamber 28. The truck body also contains a cylinder 30 which operates an horizontal hopper cover (not shown) to open and close access to the hopper 24. The rear of the truck body 12 is closed by a tailgate mechanism including a large tailgate 34 having an arcuately shaped heavy outer metal skin and pivotally connected to the truck body at the top thereof by a pair of spaced hinge mechanisms, on either side of the top rear of the truck body, one of which is shown generally at 36.

The details of the automatic tailgate latching mechanism of the present invention are best shown in the enlarged, detail views of FIGS. 2–9. These will next be addressed.

The tailgate 34 includes a structural steel frame having side members as at 40, a bottom bumper member as at 42 and top and bottom cross braces (not shown). The upper portion of each side of the tailgate includes a heavy gusset-like hinge member 44 fixed to the structural frame member 40 of the tailgate and further being provided with a pair of openings therethrough one of which carries a hinge pin 46. The other opening is connected as by a wrist pin 51 to the upper clevis 48 of a vertically mounted tailgate-operating hydraulic cylinder 50 which also has a lower clevis 52. The lower clevis 52, with further wrist pin 53, attaches the lower end of the operating cylinder 50 to a further hinged pivoting latching link member 58 which is attached to the truck body via a heavy shaft 60 journaled in a pillow block assembly 62 attached to a vertical structural member 64 which, with top and bottom members 90 and 92 and other side member 94 (FIG. 9), forms the rear frame of the truck body 12. The hinge pins, one of which is shown at 46, connect the top portion of the tailgate with structural members 54 through a pair of oversized vertically slotted openings 56 such that the hinge pin allows the tailgate 34 to be adjusted a slight amount horizontally and a larger amount vertically in addition to pivoting about the pin 46.

Figure 2:
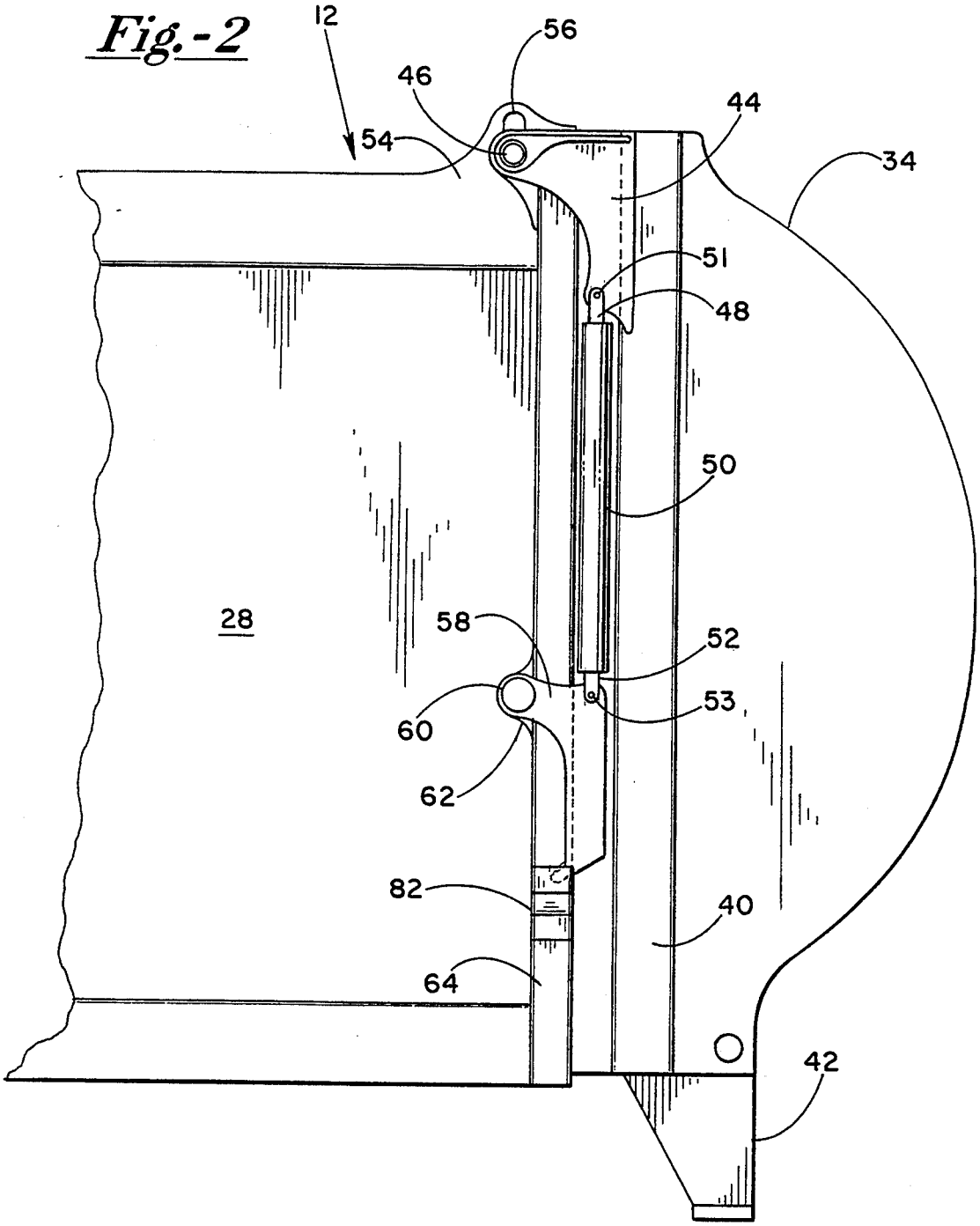
FIG. 2 is an enlarged, fragmentary view of a portion of the vehicle of FIG. 1 including the tailgate sector.
Figure 4:
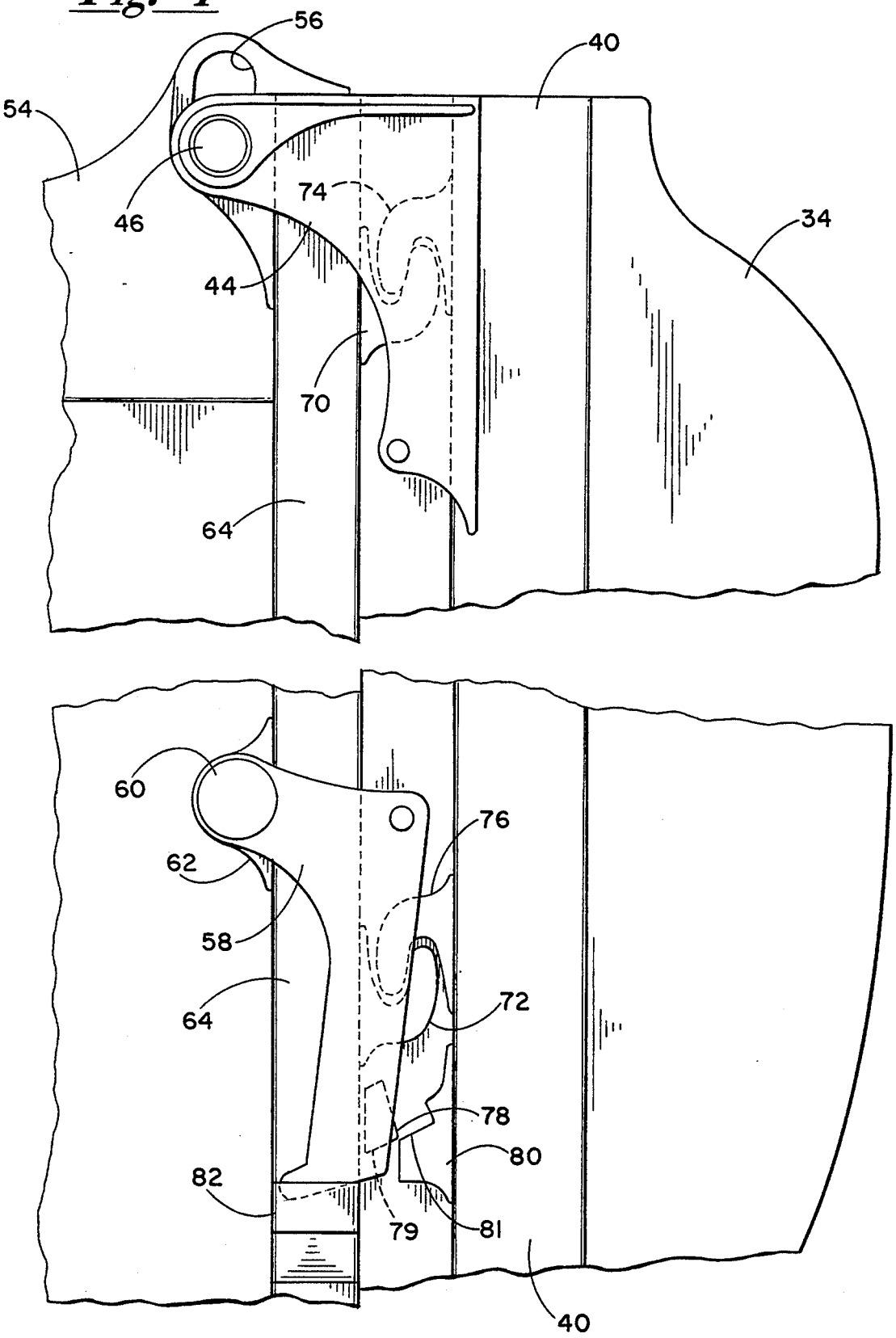
FIG. 4 is a greatly enlarged, broken, fragmentary view showing both the upper and lower latches of FIG. 2 in the lowered but unlocked position with the cylinder removed.
Figure 5:
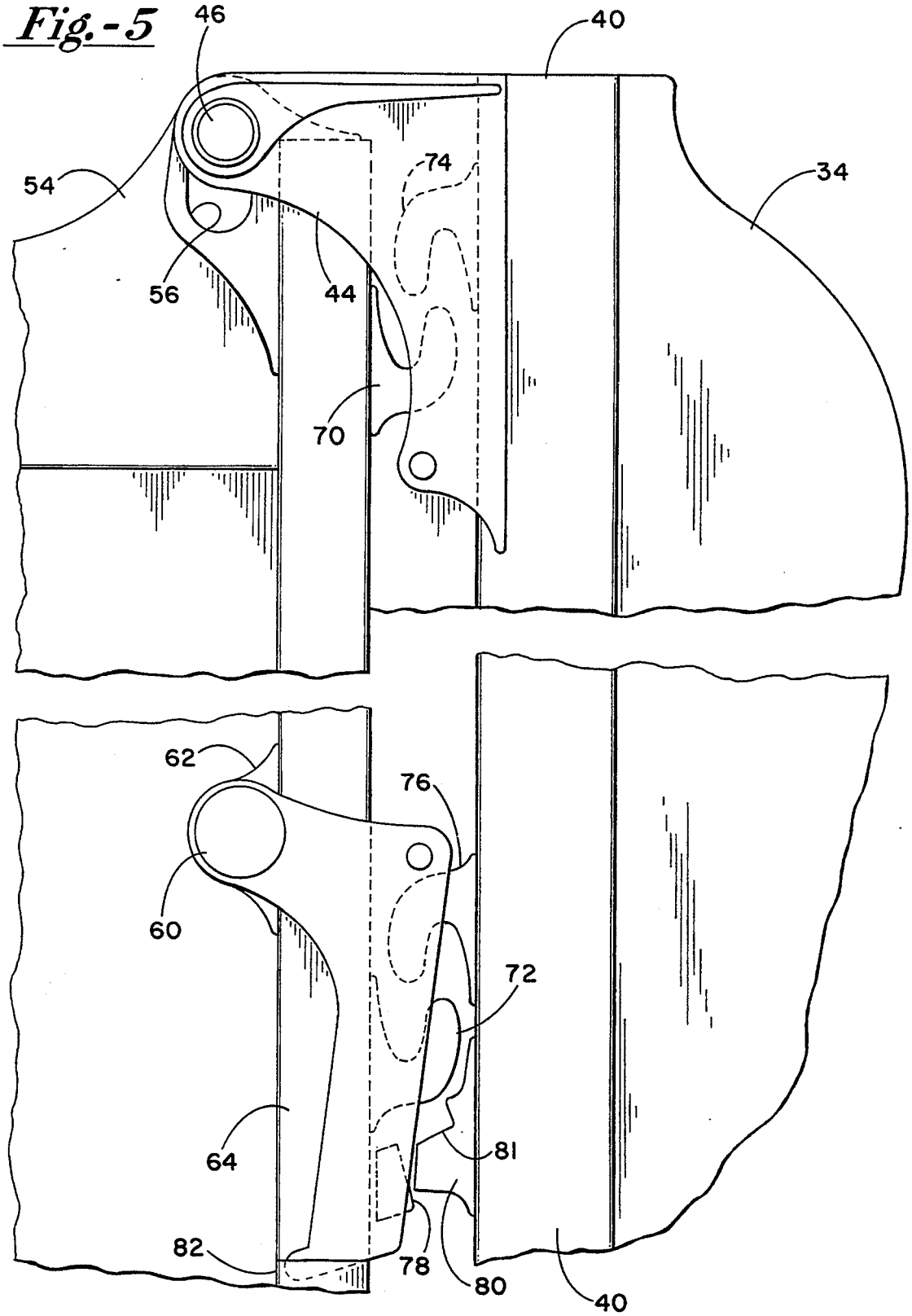
FIG. 5 is a view similar to that of FIG. 4 showing the tailgate in the raised but unopened position.
Figure 6:
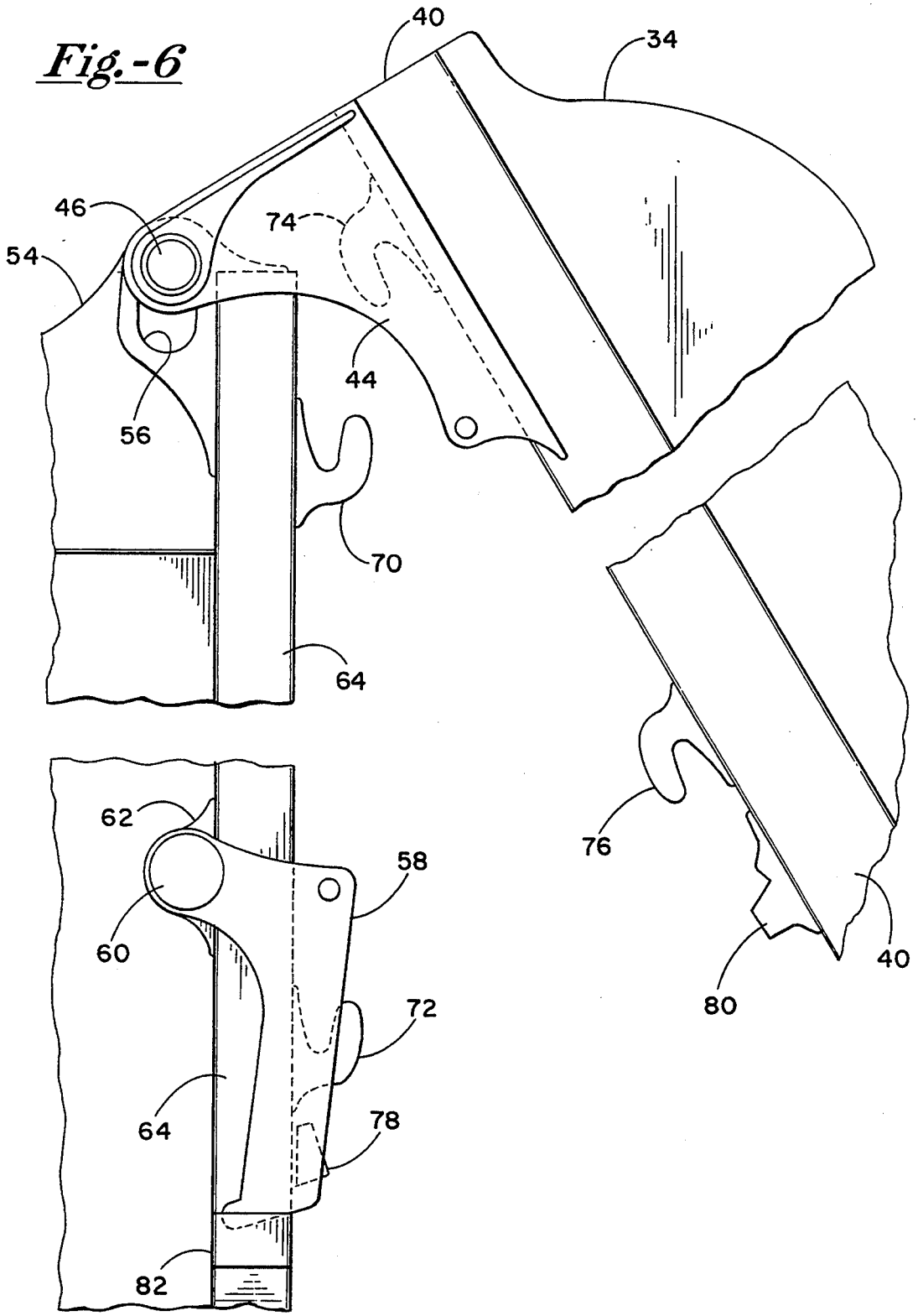
FIG. 6 is a view similar to that of FIGS. 4 and 5 showing the tailgate in the partially open position.
Figure 7:
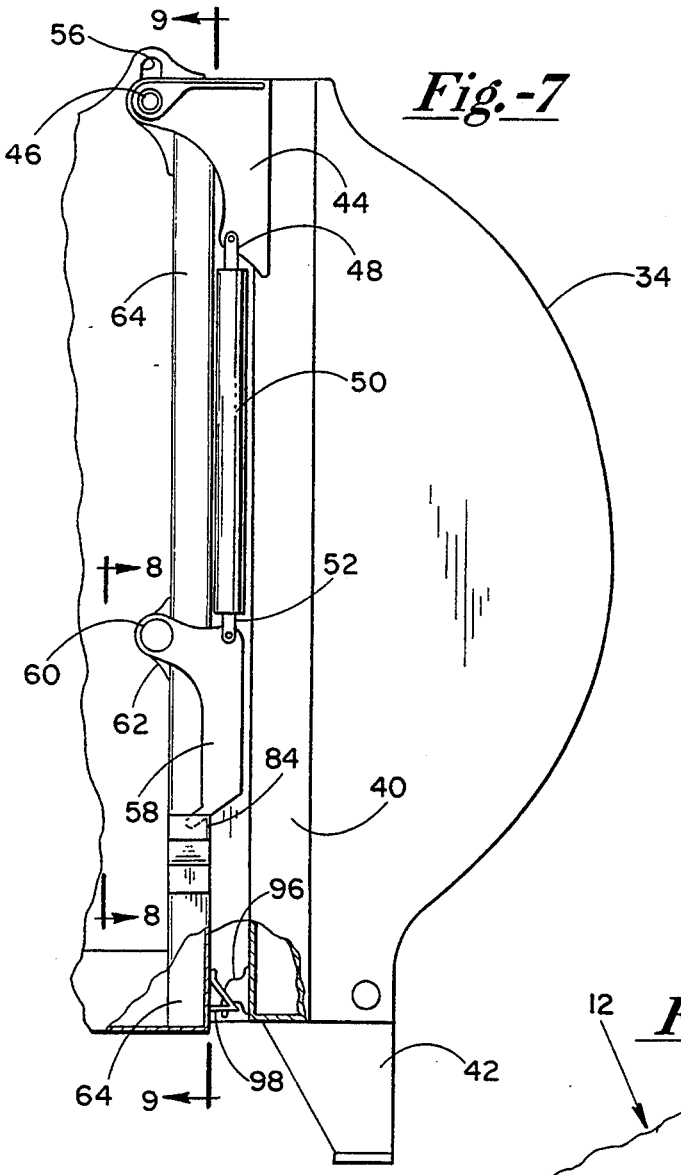
FIG. 7 is a view similar to the fragmentary view of FIG. 2 reduced with parts broken away to show a bottom latch.
Figure 8:
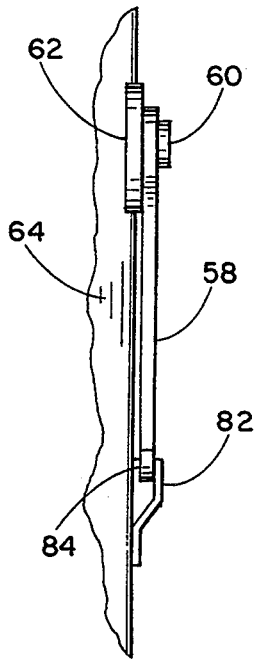
FIG. 8 is an enlarged fragmentary view taken substantially along 8—8 of FIG. 7.
Figure 9:
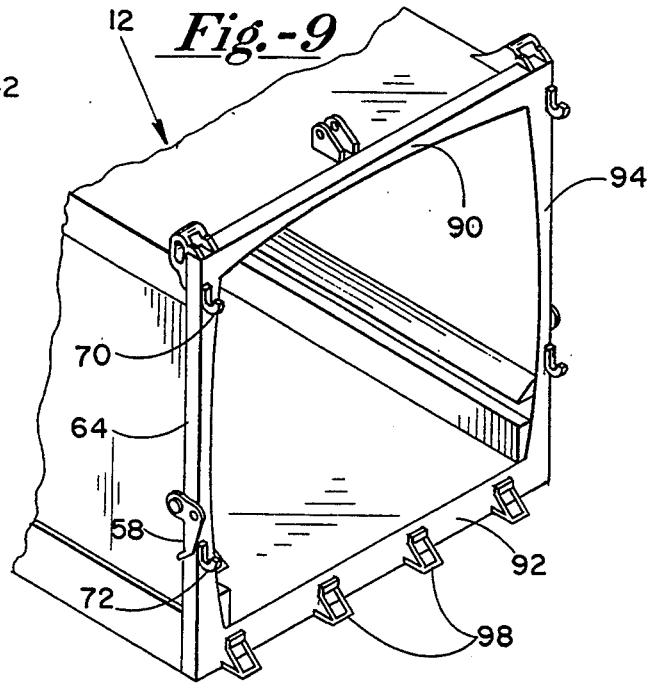
FIG. 9 is a perspective view of a portion of the truck body of FIG. 1 with the tailgate removed and showing the portions of the tailgate latch mechanisms attached to the truck body.

As will be explained later in greater detail, it can readily be seen that the cylinder 50 is shown in its fully retracted or collapsed position in FIGS. 2 and 3 and in FIGS. 4–6, as it is progressively extended, the tailgate will first be lifted in a generally vertical direction until the pins 46 reach the upper extreme of the slots 56 (FIG. 5). The latches are then fully disengaged and continued extension of the cylinder rod will cause the tailgate to swing upward, the bottom pivoting away from the rear of the truck body (FIG. 6).

Details of the latching mechanism of the invention together with the operation thereof is shown in greater detail in FIGS. 3–7. The latching mechanism includes two pairs of double hook latches, one of each pair being shown in FIGS. 3 and 4–6 in the form of generally upwardly vertically disposed upper and lower hook members 70 and 72, respectively, fixed to the vertical rear structural member 64 which coordinate with matching generally downward vertically disposed upper and lower hook members 74 and 76, respectively, fixed to the side of the matching side brace structural member 40 of the tailgate 34. A positive upper stop block member 78 with lower surface 79 is fixed to the lower pivoting gusset or hinge member 58 and a lower stop member 80 having a matching upper surface 81 is fixed to the lower portion of the brace member 40 of the tailgate 34.

Figure 3:
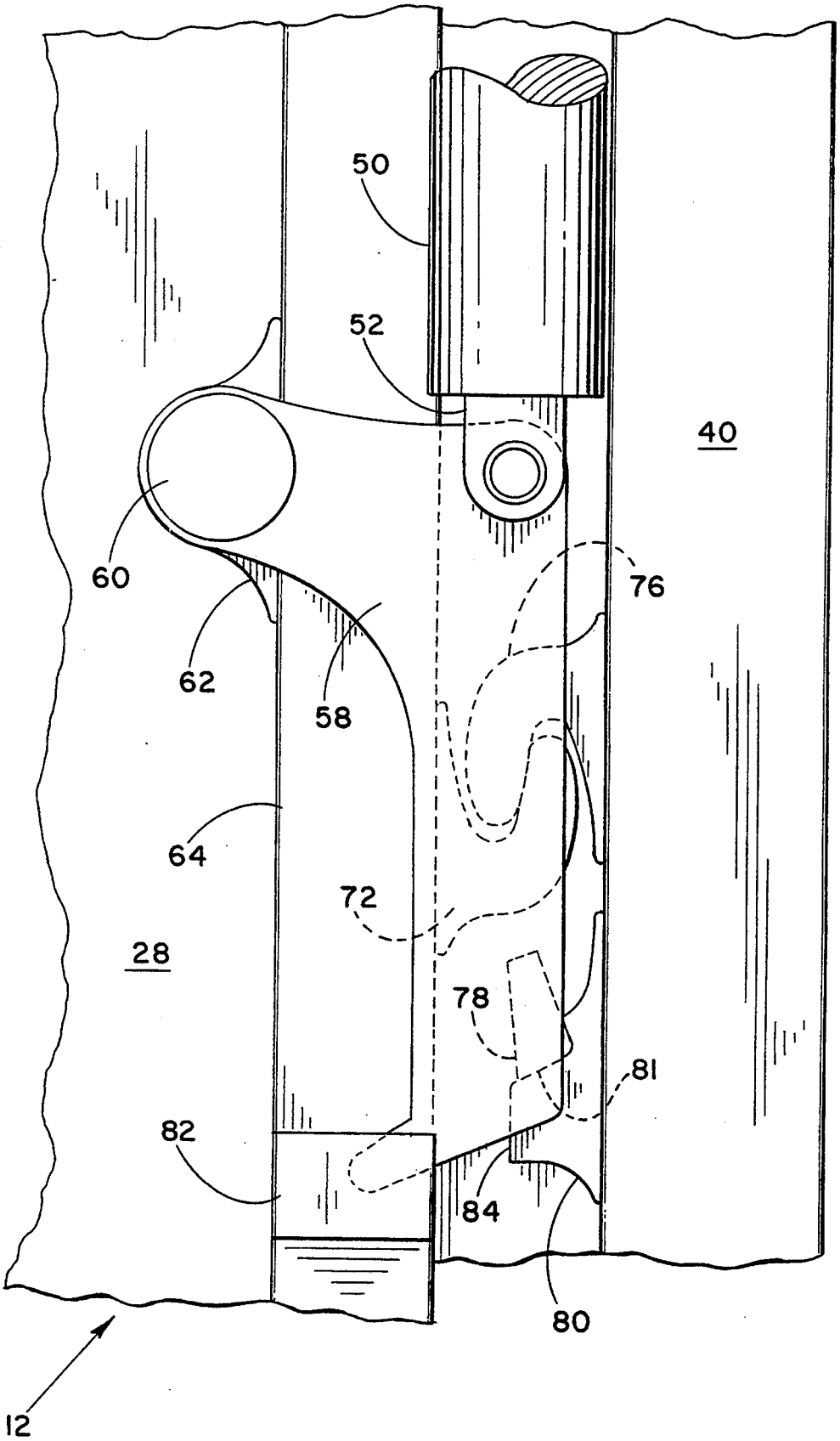
FIG. 3 is a greatly enlarged, fragmentary view depicting a lower side latch of FIG. 2 in the lowered and locked position.

FIG. 3 shows the lower portion of the system in the fully closed and locked position in which the cylinder 50 is in the fully retracted state with the tailgate fully lowered and the stops engaged. In this position, the lower truck body hook 72 is fully enmeshed with the lower tailgate hook 76 and the truck body vertical stop block member 78 fixed to latching link member 58 is in abutted engaged relationship above the tailgate stop block member 80 fixed to side brace structural brace 40 of the tailgate. The stop block member also prevents pivoting of the latching link member 58 from pivoting beyond the point necessary for stop block member 78 from clearing tailgate stop block 80. As depicted in the top segment of the broken drawing of FIG. 4, but not depicted in the precise positioning of FIG. 3, it will be appreciated that the upper hook members 70 and 74 are likewise enmeshed when the tailgate is in the lowered position. Side shifting of the members 58 together with undesired pivoting are further contained by a side retainer 82, best shown in FIG. 8, which cooperates with the member 58. This provides side guidance for each latching link member 58 and a further rear stop member 84 limits the rearward pivot distance of the latching link 58.

It is further noteworthy that the slot member 56 in which the pivot pin 46 rides is of a width dimension slightly larger than that of the pin 46 so that an amount of horizontal front to rear play exists in the pivot joint. In this manner, as horizontal force is applied by the accumulation and compaction of rubbish within the compartment 28, the horizontal or lateral force generated is carried by the hook latches 70 and 74 rather than the pivot pin 46 which is not pushed fully rearward in the slot 56 when the latches are fully engaged. The tendency for the tailgate to ride up vertically in the fully closed position when under high pressure is obviated by the provision of the stop block members as at 78 and 80 which prevent upward motion of the tailgate when the hook latches are fully engaged and the cylinder is fully collapsed (FIG. 3 ).

As perceived in the lower fragment of FIG. 4, the cylinder 50 has been slightly extended causing the lower portion of the member 58 to pivot slightly forward thereby disengaging the stop block 78 from the stop block 80 thereby thereafter allowing the tailgate to be displaced in a vertical direction by further extension of the cylinder 50. This occurs in the dual fragmentary view of FIG. 5 which records the vertical displacement of the tailgate relative to the truck body upon further elongation or extension of the hydraulic cylinder 50. Note that the upper and lower tailgate-attached hook latch members 74 and 76 are now clear of the respective truck body-attached hook latches 70 and 72, the ears 96 are free of the loops 98, and the members 58 are free of the retainer 82 (FIGS. 7 and 8) so that the tailgate is free to swing outward and upward to allow complete opening of the rear of the refuse-carrying truck body. The tailgate continues to rise vertically with respect to the truck body until the pins 46 reach the end of travel allowed by the slot 56, the further expansion or extension of the cylinder 50 thereafter causing an upward pivoting motion in the tailgate 34 as further depicted in the partially opened view illustrated in FIG. 6. Closing is accomplished by retracting the cylinders thereby reversing the opening process. The mating surfaces of the rear truck frame and the front tailgate frame are typically provided with matching resilient surface sealing devices (not shown).

It will be appreciated that the automatic positive tailgate latching mechanism of the invention provides a simplified and very effective way for providing for the punishment required to be taken by the tailgate assembly in a front-loading refuse compacting truck body by relieving the stress on the top pivot assemblies and preventing riding up of the tailgate during compression cycles. This invention has been described herein in considerable detail in order to comply with the Patent Statutes and to provide those skilled in the art with the information needed to apply the novel principles and to construct and use such specialized components as are required.

However, it is to be understood that the invention can be carried out by specifically different equipment and devices, and that various modifications, both as to the equipment details and operating procedures, can be accomplished without departing from the scope of the invention itself. For example, the hinge pins can be made movable relative to the tailgate rather than to the truck body, i.e., by putting the slots 56 in the members 44. In addition, although the invention has been illustrated specifically with regard to a front-loading, rear discharge refuse vehicle, the system works equally well with a side-loading, rear discharge embodiment.

We claim:

1. A tailgate latching mechanism for latching a vertical tailgate to the rear of a truck body of a rearward compacting, rear discharge refuse truck comprising:

vertically adjustable pivot mounting means including hinge means for pivotally securing the top of the tailgate to the top rear of the truck body structure;

means for vertically adjusting the pivot mounting means;

a pair of oppositely disposed hinged pivot connections each including a hinge pin cooperating with an opening in a hinge member fixed to the truck body and on an opening in a hinge member fixed to the tailgate such that the tailgate is pivotally suspended from the truck body by the hinge pins;

wherein the means for vertically adjusting the pivot mounting means includes means to allow limited vertical displacement of the hinge pins relative to the truck body or the tailgate;

upper and lower spaced pairs of vertically interlocking side latches for absorbing the horizontal force associated with compacting and compacted refuse when latched;

a pair of self-aligning vertical stops to prevent vertical displacement of the tailgate when closed;

a pair of lower latching link members pivotally fixed to each side of the rear of the truck body;

a pair of vertically mounted cylinder means connected between the hinge member fixed to the tailgate and the lower latching link members pivotally fixed to the truck body.

2. The tailgate latching mechanism of claim 1 wherein each of the self-aligning vertical stops includes an upper stop block member having a generally downward facing upper stop surface fixed to one of the pivoting lower latching link members and a lower stop member having a generally upward facing lower stop surface fixed to the tailgate such that when the tailgate is fully closed and latched, the lower surface of the upper stop block member matches the upper surface of the lower stop block member thereby preventing upward movement of the tailgate.

3. The tailgate latching mechanism of claim 1 further comprising containment means for limiting the pivotal travel and side deflection of the latching link members.

4. A tailgate latching mechanism for latching a vertical tailgate to the rear of a truck body of a rearward compacting, rear discharge refuse truck comprising:

(a) vertically adjustable pivot mounting means including hinge means for pivotally securing the top of the tailgate to the top rear of the truck body structure;

(b) means for vertically adjusting the pivot mounting means;

(c) spaced upper and lower pairs of vertically interlocking side latches for absorbing the horizontal force associated with compacting and compacted refuse when latched;

(d) a pair of self-aligning vertical stops to prevent upward vertical displacement of the tailgate when the tailgate is closed, wherein each of the self-aligning vertical stops includes an upper stop block member having a generally downward facing upper stop surface and a lower stop member having a generally upward facing lower stop surface such that when the tailgate is fully closed and latched, the lower surface of the upper stop block member lies above the upper surface of the lower stop block member thereby preventing upward movement of the tailgate.

* * * * *